United States Patent [19]

Oswalt et al.

[11] Patent Number: 4,818,004

[45] Date of Patent: Apr. 4, 1989

[54] ROTOR BLADE SLING

[75] Inventors: Malcom C. Oswalt; Ralph Hulihee, both of Mesa, Ariz.

[73] Assignee: McDonnell Douglas Corporation, Long Beach, Calif.

[21] Appl. No.: 121,412

[22] Filed: Nov. 16, 1987

[51] Int. Cl.[4] ..... B66C 1/10

[52] U.S. Cl. ..... 294/81.3; 294/67.21; 294/67.22; 294/67.5; 294/81.6

[58] Field of Search ..... 294/1.1, 67.1, 67.21, 294/67.22, 67.4, 67.5, 74, 81.1, 81.2, 81.3, 81.4, 81.5, 81.55, 81.6, 81.61, 86.4, 86.41, 101, 103.1, 119.4, 901, 82.12, 82.15, 82.17

[56] References Cited

U.S. PATENT DOCUMENTS

| | | | |
|---|---|---|---|
| 2,412,555 | 12/1946 | Baker | 294/81.61 X |
| 2,844,404 | 7/1958 | Haugh et al. | 294/86.41 X |
| 2,986,422 | 5/1961 | Renfroe | 294/101 |
| 3,123,392 | 3/1964 | Jacobson | 294/81.3 |
| 3,724,891 | 4/1973 | Brickley | 294/81.4 |
| 3,837,697 | 9/1974 | Goodrich | 294/82.12 X |

FOREIGN PATENT DOCUMENTS

| | | | |
|---|---|---|---|
| 412112 | 1/1974 | U.S.S.R. | 294/81.6 |
| 596530 | 3/1978 | U.S.S.R. | 294/67.5 |

*Primary Examiner*—Johnny D. Cherry

*Attorney, Agent, or Firm*—Paul T. Loef; George W. Finch; John P. Scholl

[57] ABSTRACT

A sling for attachment to a hoist for accurately adjusting the position of a helicopter rotor blade to ease the installation of the rotor blade in the rotor hub while attached to a helicopter. Blade orientation is adjustable in the sling by providing a spherical clamp which is attached to the hoist and a spherical race or sliding surface bearing on the spherical clamp and attached to the sling. The sling adjusts the blade position so that the center of gravity of the blade is located approximately at the center of the radius forming the surface of the spherical race. Hence, only the axis being adjusted is effected.

6 Claims, 2 Drawing Sheets

FIG. 1.
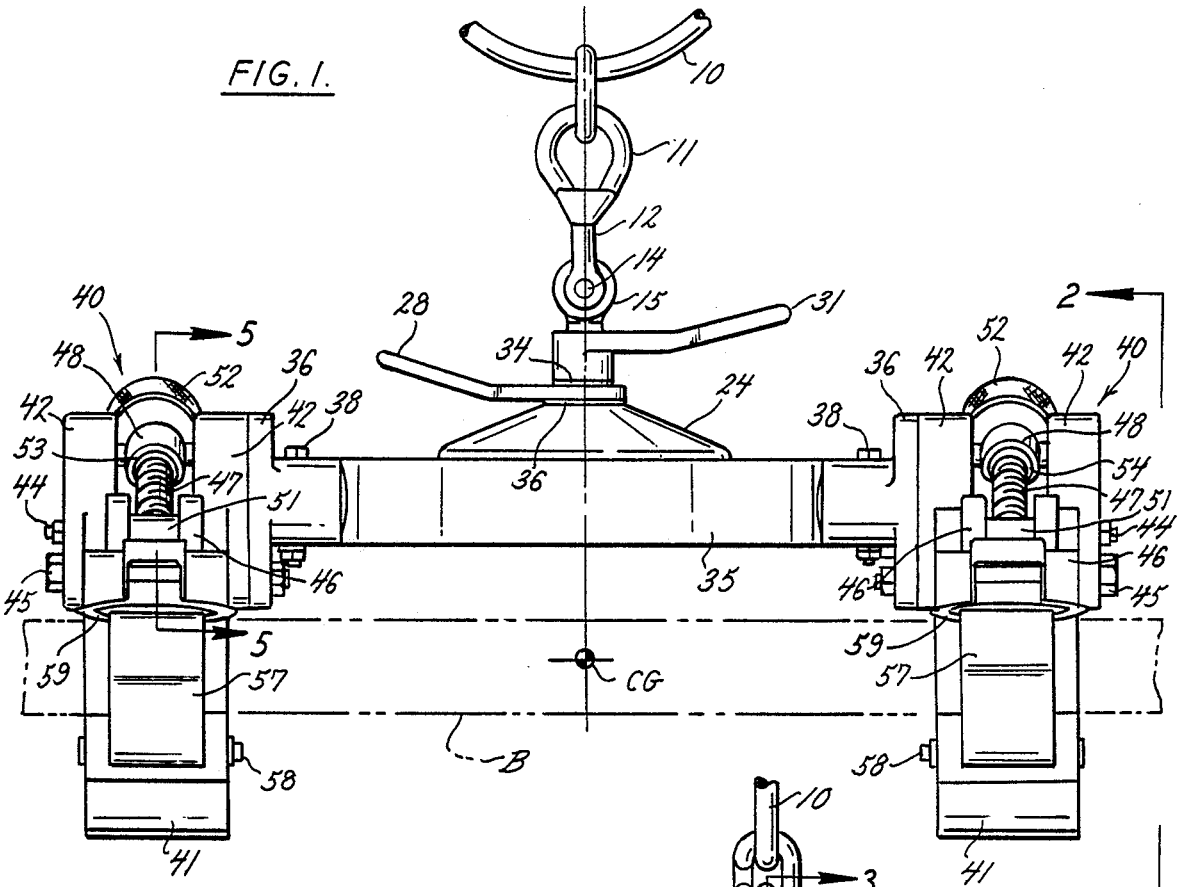
FIG. 5.
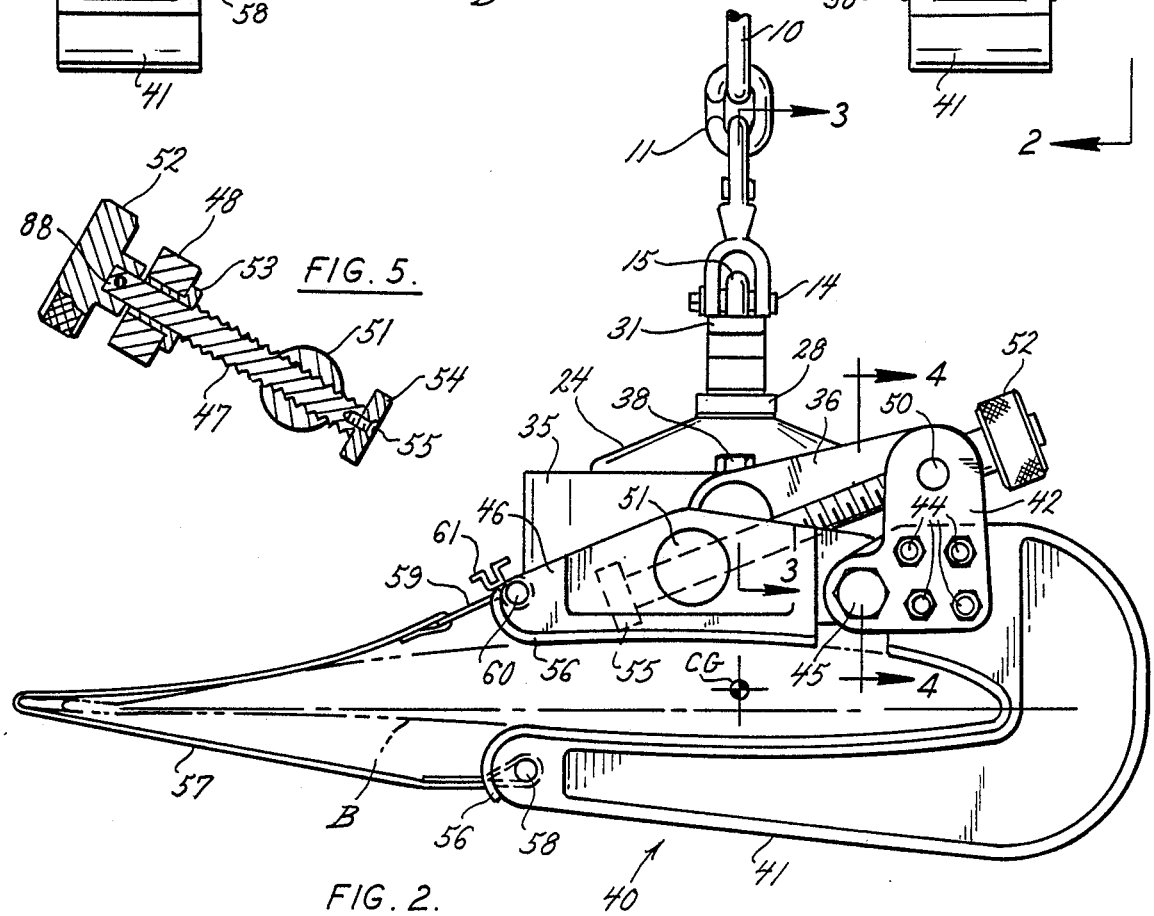
FIG. 2.

ROTOR BLADE SLING

STATEMENT OF GOVERNMENT INTEREST

The invention described herein may be manufactured and used by or for the Government for Governmental purposes without the payment of any royalty thereon.

BACKGROUND OF THE INVENTION

This invention relates to lifting devices or slings for lifting helicopter blades when installing a blade in a central hub to complete a helicopter rotor system.

Helicopters, generally, have two to six blades attached to a central hub which in turn is attached to the drive shaft of the engine. The cross section of a helicopter blade is shaped like a cross section of an airplane wing; the blade is an air foil and produces lift. The blades and hub make up a rotory wing, or rotor. On older helicopters the blades were attached to the hub by horizontal hinges which allowed them to "flap", or move up and down, and they were also attached by vertical hinges which allowed them to "lead and lag", or move forward and backward, relative to a straight-out position. Since the blade is a lifting surface, means are provided to change the angle of attack or pitch of the blade by rotating the blade along its longitudinal axis. Current helicopters provide a mechanical coupling between the rotor blades and the hub by terminating the inboard end of a blade in a flexure portion which accommodates the necessary movement of the blade by deflection. Flexure type couplings not only eliminate the two hinges, but the blade incorporates a pretwist at the blade root to minimize torsional stresses. This pretwist is in the range of 30°. Also, the blade is typically installed at some predetermined flap angle other than horizontal.

Typically, the blade is joined to the flexure through some type of clevis joint which may be a double clevis with a common middle leg. For a better understanding of the typical flexure couplings and the blade terminations, see U.S. Pat. No. 4,650,401. Since the rotor-blade-to-flexure coupling is a highly stressed connection, the fit up tolerances are snug, and installation and removal of the blades requires accurate alignment between the blades and the hub or flexure.

In the prior art, a pair of conventional fabric slings with a spreader bar between them was used in conjunction with an overhead hoist to support the blade during removal and installation and to provide the necessary freedom of movement to align the two mating parts. As previously discussed, aligning the blades requires simultaneous flap and pitch movement which was provided by a man applying restraining moments on the blade to maintain the flapped and pitch position. Of course, shifting the center of gravity of the blade caused a necessary correction in the other alignment parameters.

It is an object of this invention to provide a rotor blade sling which in combination with an overhead hoist accommodates angular adjustment about the conventional X, Y and Z axes as well as translational displacement about these axes. It is a further object of this invention to provide a device which accommodates angular adjustment about one axis with minimum effect on the other axes by eliminating unbalanced moments; i.e., rotating about one axis produces only the desired change in orthographic projection of the points on the blade.

SUMMARY OF THE INVENTION

In summary, the apparatus of this invention accomplishes the above objectives by providing a sling for attachment to a hoist for adjustably positioning a helicopter rotor blade for mating the blades with the rotor hub. The sling has a lower flap with a spherically shaped outer bearing surface. It supports a spherically shaped race so that the race is slidably adjustable with respect to the lower clamp. Supported from the race is a pair of beam clamps which position the helicopter blade in a generally horizontal position so that the center of gravity of the blade is located approximately at the center of the spherical race surface. This arrangement allows the blade to be rotated on its longitudinal axis so as to change the pitch of the blade or to rotate the blade about a vertical axis perpendicular to the longitudinal axis so as to adjust the flap angle of the blade, and the center of the gravity of the blade is always maintained at the center of the spherical bearing surface. Therefore, no external moments due to unbalance of the blade about its support are present to interfere with proper orientation of the blade for mating with the rotor hub. Obviously, and as in the prior art, change in the lag-lead angle of the blade is most easily controlled by rotation about the hoist cable. Also, X, Y and Z axis displacement is provided by the hoist.

BRIEF DESCRIPTION OF THE DRAWINGS

With reference to the drawings wherein like reference numerals designate like portions of the invention:

FIG. 1 is a front projection of the rotor blade sling;

FIG. 2 is an end view of the rotor blade sling;

FIG. 5 is a partial section through the blade support clamp.

DESCRIPTION OF THE PREFERRED EMBODIMENT

Figure 3:
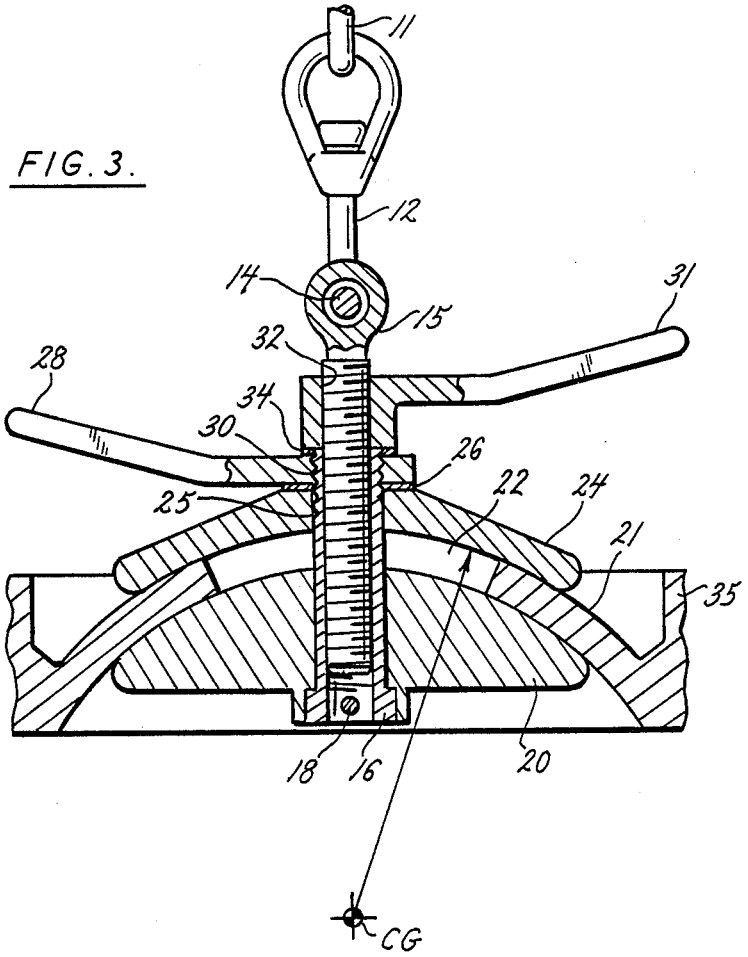
FIG. 3 is an enlarged cross section view through the spherical clamp portion of the sling as cut in FIG. 2.

FIGS. 1 and 2 are elevation and end views of the hoist apparatus. Ring 10 is the portion of the hoist which engages the hook (not shown) of the overhead hoist for lifting purposes. Connecting to the ring 10 is a link 11, and it, in turn, connects with the swivel 12. Bolt 14 connects the swivel to the clamping screw 15. The clamping screw 15 in turn engages a nut 16 (see FIG. 3) which is pinned at 18 to the lower clamp 20. Engaging the lower clamp is the spherical race 21 which has an oversize aperture 22 to allow for adequate rotational displacement of the spherical race on its lower clamp 20 without hitting the nut 16 so as to allow for adjustment. Clamp 24 engages the upper surface of the spherical race 21 which has a central hole at 25 which clears the outside diameter of the nut 16, but it is free to slide up and down and rotate about the outside diameter of the nut 16. Engaging a flat surface on the upper surface of the clamp 24 is a washer 26 so as to allow for sliding engagement of the lower surface of the torque handle 28 which, in turn, threadably engages the outside diameter of the upper end of the nut 16 as shown at 30 so that advancement of the handle 28 about the threads at 30 clamps the upper and lower clamps 24 and 20 against the spherical race 21. Locking handle 31 has a threaded bore at 32 which engages the threads on the clamping screw 15 and acts so as to lock the clamping screw 15 by bearing against the washer 34 which in turn bears against the upper end of the nut 16.

Figure 4:
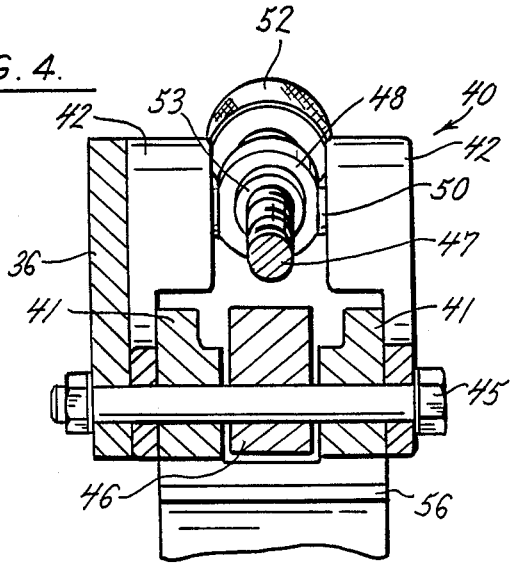
FIG. 4 is a partial section through the hinge portion of the rotor blade support means as cut in FIG. 2 with the clamp screw removed for clarity.

The flanged structure 35 surrounding and integral with the spherical race 21 terminates on both outboard ends in a pair of opposing flanges 36 attached by a series of bolts and nuts shown at 38. Attached to the flanges 36 is the beam clamp 40 which consists of a fixed lower beam 41 to which is attached a pair of trunnion supports 42 by the fasteners 44 (omitted from FIGS. 1 and 4 for clarity). Pivoted from the trunnion supports 42, by the bolt and nut 45, is the hinged clamp 46 which in turn is driven by the clamp screw 47. The clamp screw 47 is slidably supported by the support 48 which terminates in a pair of trunnions 50, which, in turn, is supported by a bore in the trunnion supports 42. The clamp screw 47 terminates on one end 88 with a knurled knob 52 for hand turning and is supported by the support 48, which allows the screw to turn but not advance as it is retained by the knurled head 52 and the collar 53 on the clamp screw 47 (see FIG. 5). The clamp screw 47 threadably engages the cylindrical nut 51 which is in turn supported in the hinge clamp 46, and the screw has a stop shown at 54 attached by the screw 55.

The opening in the main clamp 40 which is formed by the lower beam 41 and the hinged clamp 46 is generally shaped to the cross sectional configuration of the blade B. A pad or insert is shown at 56 in the particular embodiment shown. However, the insert 56 can be made with different openings to support diverse rotor blades. However, it is important to note that the center of gravity of everything supported on the spherical race 21 which includes the flange structure 35 and the beam clamps 40 as well as the rotor blade, must be positioned so that the center of gravity (CG) of this combination is located essentially under the hoist hook line and at the center of the radius of the spherical race 21 so that there are not any overturning moments due to unbalance tending to make the hoist rotate on the spherical bearing. This is true in the planes of both FIG. 1 and FIG. 2 as well as the center of gravity, shown at 58, which must also be essentially the virtual center of the radius for the spherical race 21. Straps 57 are shown as a safety provision to ensure that the blade cannot fall out of the hoist in the event the blade should hit something in its travels. The strap 57 is shown with pin 58 connected at one end and a strap hook 59 at the other end engaging the pin 60 with a manual means for grasping the strap and unhooking same at 61.

It should now be reasonably clear that adjustment of the blade about the longitudinal twist axis of the blade to provide blade pitch and concurrent flap adjustment about the longitudinal balance point of the blade can be readily provided by adjusting the spherical clamp. Since the pitch adjustment is around the twist axis and the flap turns around the center of gravity and twist intercept, there are no restraining moments required to be provided by manpower or otherwise, as discussed in the Background of the Invention, to maintain the rotor blade in the desired position. The lead lag angle is best adjusted about the hoist cable which was also true in the prior art.

It is to be understood that the shown embodiment is merely illustrative of, and not restrictive of, the broad invention. It is not intended to limit the invention to the specific arrangements, constructions or structures described for various modifications thereof may be accomplished by persons having ordinary skill in the art.

What is claimed is:

1. A helicopter blade sling for attachment to a hoist for accurately positioning rotor blades, having a longitudinal axis and a center of gravity, comprising:

a lower clamp shaped as a segment of a sphere and having an outside surface;

a tube centrally attached to and protruding from said lower clamp and having an end termination adapted to engage said hoist;

a race having generally parallel arcuately shaped outside and inside surfaces generated about a common center, said inside surface conforming to and bearing against said outside surface of said lower clamp and said race having an aperture therein so as to permit rotation of said race relative to said lower clamp and said tube attached to and protruding from said lower clamp;

means attached to said race for supporting said rotor blade so that said rotor blade's center of gravity approximately coincides with said common center of said arcuately shaped surfaces of said race; and means to lock said race with respect to said lower clamp.

2. The sling of claim 1 wherein said means attached to said race for supporting said blade so that said blade's center of gravity approximately coincides with the center of said arcuately shaped surfaces of said race further comprises a pair of beam clamps spaced from each other, attached to said race and having openings adapted to receive said blade with its longitudinal axis oriented in a generally horizontal position and sized so that when said blade fits snugly in said beam clamps, it is oriented with said blade's center of gravity approximately coincidental with said center of said arcuately shaped surfaces of said race.

3. The sling of claim 2 wherein each of said openings is provided with a removable insert having an inside shape adapted to fit said blade and an outside shape adapted to fit said opening in said beam clamp whereby different shaped blades can be accommodated.

4. The sling of claim 1 wherein said tube centrally attached to and protruding from said lower clamp has internal threads inside said tube and external threads outside said tube and wherein said end termination for engaging said hoist is a clamping screw having external threads engaging said internal threads inside said tube and having an end termination for engaging said hoist and said means to lock said race with respect to said lower clamp comprises an upper clamp having a generally arcuately shaped inside surface engaging said outside surface of said race and having an aperture to slide over said tube and a first nut engaging said external threads on said tube and a second nut engaging said external threads on said clamping screw.

5. A helicopter blade sling for attachment to a hoist for accurately positioning rotor blades, having a longitudinal axis and a center of gravity, when mating the blades with a rotor hub, comprising:

a lower clamp shaped as a segment of a sphere and having an outside surface;

means to attach said lower clamp to said hoist;

a race, generally shaped as a spherical segment with parallel outside and inside surfaces generated about a common center, said inside surface generally conforming to and bearing against said outside surface of said lower clamp and said race having an aperture therein so as to permit rotation of said race relative to said lower clamp and said means to attach said clamp to said hoist;

a pair of beam clamps spaced from each other, attached to said race and having openings adapted to receive said blade with its longitudinal axis oriented in a generally horizontal position;

removable inserts having an outside shape adapted to fit each of said openings in said pair of beam clamps and having inside shapes adapted to fit said blade so that when said blade fits snugly into said inserts it is oriented with said blade's center of gravity approximately coincidental with said common center, whereby different shaped blades can be accommodated; and means to lock said race with respect to said lower clamp.

6. The sling of claim 5 further comprising straps having first and second ends, said first end pivotally attached to said beam clamps and adapted to encompass said blade and removably attached to said beam clamps at the second end so as to secure said blade in each of said openings in said beam clamps.

* * * * *